US012595596B2

(12) United States Patent
Konukoğlu et al.

(10) Patent No.: US 12,595,596 B2
(45) Date of Patent: Apr. 7, 2026

(54) CORE SPUN YARN COMPRISING SHORT CELLULOSIC STAPLE FIBERS AND PROCESS FOR ITS PRODUCTION

(71) Applicant: Sanko Tekstil Isletmeleri San. Ve Tic. A.S., Inegol-Bursa (TR)

(72) Inventors: Fatih Konukoğlu, Inegol-Bursa (TR); Eşref Tuncer, Inegol-Bursa (TR); Şeref Ağzikara, Inegol-Bursa (TR); Erdoğan Bariş Özden, Inegol-Bursa (TR); Sedat Demirbüken, Inegol-Bursa (TR)

(73) Assignee: SANKO TEKSTIL ISLETMELERI SAN. VE TIC. A.S., Inegol—Bursa (TR)

( * ) Notice: Subject to any disclaimer, the term of this patent is extended or adjusted under 35 U.S.C. 154(b) by 0 days.

(21) Appl. No.: 18/640,143

(22) Filed: Apr. 19, 2024

(65) Prior Publication Data

US 2024/0352629 A1 Oct. 24, 2024

(30) Foreign Application Priority Data

Apr. 20, 2023 (EP) ..... 23169026

(51) Int. Cl.
*D02G 3/36* (2006.01)
*D01H 1/02* (2006.01)
(Continued)

(52) U.S. Cl.
CPC ..... *D02G 3/36* (2013.01); *D01H 1/02* (2013.01); *D02G 3/04* (2013.01); *D02G 3/32* (2013.01);
(Continued)

(58) Field of Classification Search
None
See application file for complete search history.

(56) References Cited

U.S. PATENT DOCUMENTS 4,921,756 A * 5/1990 Tolbert ..... D02G 3/185 428/377
4,946,467 A * 8/1990 Ohi ..... D07B 1/02 606/228
(Continued)

FOREIGN PATENT DOCUMENTS

CN 106149096 A * 11/2016 ..... D01D 5/34
CN 218026558 U 12/2022
(Continued)

OTHER PUBLICATIONS

"Spandex: History of Spandex Fabric." Fulgar. Feb. 27, 2023. https://www.fulgar.com/en/feature/191/what-is-spandex-history-of-spandex (Year: 2023).*
(Continued)

*Primary Examiner* — Grace Huang

(57) ABSTRACT

A yarn comprising a filament core and a staple fiber sheath, the staple fiber sheath comprises at least 95% by weight of a blend of first fibers and second fibers. The first fibers are natural cellulosic fibers and the second fibers are regenerated cellulosic fibers, wherein the weight ratio of the first fibers to the second fibers is in the range of 70/30 to 80/20, the weight ratio preferably being about 75/25; the average length of the fibers of the sheath is in the range of 10 to 25 mm, preferably 12 mm to 20 mm; the 5% (n) index of the fibers of the sheath is between 25 mm and 40 mm, more preferably in the range between 28 and 36 mm; the short fiber content SFC(n) of the sheath is between 30% and 70%; and the filament core comprises a plurality of polyester filaments.

19 Claims, 3 Drawing Sheets

(51) Int. Cl.
*D02G 3/04* (2006.01)
*D02G 3/32* (2006.01)

(52) U.S. Cl.
CPC ..... *D10B 2201/02* (2013.01); *D10B 2201/24* (2013.01); *D10B 2331/04* (2013.01); *D10B 2331/10* (2013.01)

(56) References Cited

U.S. PATENT DOCUMENTS 6,620,212 B1 * 9/2003 Handermann ..... D02G 3/443 8/522
6,723,428 B1 * 4/2004 Foss ..... B32B 27/306 428/324
7,155,891 B2 * 1/2007 Bader ..... D02G 3/367 57/210
7,749,600 B1 * 7/2010 Patrick ..... A47L 13/20 428/357
8,093,160 B2 * 1/2012 Tharpe, Jr. ..... D02G 3/32 442/190
10,167,579 B2 * 1/2019 Kilickan ..... D03D 15/47
11,773,515 B2 * 10/2023 Estreicher ..... D02G 3/04 57/244
12,215,443 B2 * 2/2025 Konukoğlu ..... D02G 3/36
12,286,729 B2 * 4/2025 Ozden ..... D02G 3/12
12,331,433 B2 * 6/2025 Mittal ..... D03D 15/283
2003/0205041 A1 * 11/2003 Baker Jr. ..... D02G 3/36 57/224
2013/0101781 A1 * 4/2013 Lee ..... D02G 3/36 428/221
2013/0330992 A1 * 12/2013 Mitchell ..... D06P 3/8223 8/652
2015/0176160 A1 * 6/2015 Lee ..... D03D 15/49 428/221
2016/0024692 A1 * 1/2016 Yung ..... D03D 15/56 139/421
2020/0291550 A1 * 9/2020 Finck ..... D02G 3/04
2020/0399796 A1 * 12/2020 Couture ..... D02G 3/36
2021/0047757 A1 * 2/2021 Cleveland ..... A41B 11/00
2024/0011200 A1 * 1/2024 Kim ..... D02J 1/08
2024/0279849 A1 * 8/2024 Yasuda ..... D03D 15/47
2024/0294354 A1 * 9/2024 Yasuda ..... D03D 15/47

FOREIGN PATENT DOCUMENTS

EP 2006422 A1 12/2008
EP 3599304 A1 1/2020
WO WO-2018127991 A1 * 7/2018 ..... D03D 15/283

OTHER PUBLICATIONS

"Rayon, Viscose, Modal." Sustain Your Style. Jan. 14, 2021. https://www.sustainyourstyle.org/en/rayon-viscose-modal (Year: 2021).*
Yang, S et al. "Assessing Raw Cotton on Predicted Yarn Quality: A New Approach to Marketing Cotton." CSIRO Manufacturing. Dec. 5, 2023. https://baumwollboerse.de/wp-content/uploads/vortraege/Gordon-Assessing-raw-cotton-on-predicted-yarn-quality-Bremen-FINAL-Jan18.pdf (Year: 2023).*
Liu, Yongliang, et al. "Comprehensive Analysis of Cotton Fiber Infrared Maturity Distribution and Its Relation to Fiber HVI and AVIS Properties." Fibers and Polymers. Jan. 26, 2024. https://link.springer.com/article/10.1007/s12221-023-00448-6 (Year: 2024).*
European Search Report and written opinion issued by the EPO on Dec. 12, 2023 for European priority application No. 23169026.4.

* cited by examiner

CORE SPUN YARN COMPRISING SHORT CELLULOSIC STAPLE FIBERS AND PROCESS FOR ITS PRODUCTION

RELATED APPLICATION

This application is related to and claims priority to European Application EP 23169026.4 titled A Core Spun Yarn Comprising Short Cellulosic Staple Fibers and Process For its Production, filed on Apr. 20, 2023, the contents of which are hereby incorporated by reference as if set forth in their entirety.

FIELD OF THE INVENTION

The present invention relates to the field of yarn production. In greater detail, the present invention relates to a yarn using short cellulosic, e.g. cotton, staple fibers typically obtained from recycling of yarns and fabrics, and to a process for the production of said yarn. The invention also relates to a method of recycling cotton fabrics.

BACKGROUND

Due to the costs and to the environmental impact of natural fibers production, methods have been developed to recycle natural fibers from textile waste, in order to re-use them. A prominent example is recycling cotton from waste textiles, in particular fabrics and yarns waste, in order to obtain recycled cotton fibers.

Known recycling processes for fabrics and yarns generally include mechanically breaking down the textiles into loose fibers that can be used for spinning new yarns. In this process, machines are used that break down the fabric e.g. by means of rotating drums with metal pins. The mechanical strain on the fibers in the yarns causes the breakage of original fibres into shorter fibres.

A problem with recycled cotton fibers is that their content of short length fibers makes them unsuitable or badly suitable for yarn manufacturing, in particular in ring spinning machines for denim production. Virgin cotton staple fibers have a greater amount of long fibers than recycled cotton fibers; e.g. the average length L(n) (considering all of the fibers of a yarn) of virgin cotton is usually greater than 20 mm, while recycled staple cotton fibers have an average length L(n) that is usually below 15 mm, usually between 6 and 15 mm, more commonly between 9-12 mm.

It is thus difficult to properly use the recycled (short) cotton fibers in yarn production by ring spinning.

The short length of cotton fibers result in a yarn having a too low strength, resulting in a poor fabric, or may not even be workable into a yarn due to the breakages of the combined fibers occurring in the yarn manufacturing machines. For this reason, recycled cotton fibers have been mixed with virgin cotton fibers to impart to the final yarn acceptable mechanical properties and physical characteristics, such as the bulkiness and appearance, of yarns containing 100% virgin natural fiber, e.g. virgin cotton. The ratio of the amount of virgin cotton fibers (CO) to recycled cotton fibers (RCO) by weight in a yarn depends from the yarn production technique. Typically, open end yarns may comprise up to 100% recycled cotton, while in ring spun yarns RCO content does not exceed 40% (by weight) and generally the ratio (by weight) CO/RCO is in the range of 70/30 to 90/10.

It has also been proposed to improve the mechanical properties of yarns containing recycled cotton fibers with the use of polyester filaments and fibers. In an embodiment polyester staple fibers are mixed with cotton fibers before being spun into a yarn; these yarns have the drawback that due to the presence of polyester they cannot be easily dyed and have a poor look, i.e. a non-cotton look. Proposed embodiments in which polyester filaments are provided as core filaments in a recycled cotton sheath have the above mentioned disadvantage of necessarily having a low content of recycled cotton fibers. Additionally, they have also failed to solve the problem, particularly because the recycled cotton fibers sheath breaks easily when stretched or tensioned.

There is thus the need to solve the problems of the prior art and to provide a yarn in which all the cotton fibers are recycled fibers, the yarn is a ring spun yarn and has a good look and good to excellent mechanical characteristics.

SUMMARY OF THE INVENTION

An aim of the present invention is thus to provide a yarn in which all the cotton fibers may be recycled, short length, cotton fibers and that has good to excellent mechanical properties and the look and aspect of a yarn including virgin cotton fibers.

Another aim of the invention is to provide a core spun yarn containing short length cotton fibers that is elastic and stretchable.

Said aims are reached by means of the present invention that relates to a yarn according to claim 1.

The invention also relates to a method of producing a core spun yarn having a sheath containing recycled, i.e. short length, cotton fibers according to claims 13 and 16. A further object of the invention is a blend of staple fibers according to claim 12.

In particular, the present invention relates to a yarn and a relevant production method according to the enclosed independent claims, while preferred aspects are recited in the dependent claims.

The wording "blend of fibers" in the present description is used to identify a mixture of different fibers that is suitable to be used in a ring spinning process to provide the sheath of a core spun yarn. Single fibers in the sheath of the invention yarn can be identified and if required physically removed from the blend forming the sheath.

For the present invention, the term "regenerated cellulosic fiber" or "man-made fiber" indicates any kind of cellulose-based staple fiber which is industrially produced. This term includes all kinds of regenerated cellulosic fibers, such as lyocell, viscose, modal, bamboo (commercially available bamboo fiber is usually a regenerated cellulosic fiber produced from bamboo, i.e. a synthetic rayon made from cellulose extracted from bamboo), polynosic fiber, cupro, acetate, etcetera. Such man-made staple fibers have a substantially constant length, so that the length of these fibers falls within a very small range, i.e. they have a low value of CV (i.e. coefficient of variation). For the present invention the average length of these fibers measured with DIN 53805:1980-06, is in the range of 25 mm to 38 mm, preferably 29 mm to 35 mm. The preferred count of the regenerated fibers suitable for the invention is in the range of 1 dtex to 3 dtex, preferably about 1.2 dtex. Preferred regenerated cellulosic fibers for the present invention are sustainable cellulosic fibers, such FSC certified regenerated cellulosic fibers.

For the present invention, the term "virgin fiber" indicates cotton staple fibers deriving from cotton that has not been worked into yarns and fabrics and that therefore has a high average length of the fibers.

For the present invention the term "natural cellulosic fibers" indicates fibers obtained from the bodies of plants or animals. Preferred natural cellulosic fibers are fibers as obtained or as obtainable from the recycling process of fabrics and fibers coming from plants such as cotton, hemp, linen and so on. Typically, natural cellulosic fibers used in the invention are recycled fibers, having count close to each other, and they are usually within the count range of the regenerated cellulosic fibers.

The term "recycled cotton fibers" in the following description indicates staple fibers of cotton deriving from the mechanical treatments, e.g. opening and sorting, of yarns and fabrics; a possible way to identify these fibers is by measuring their average fiber length. In embodiments, the fiber average length L(n), as measured with DIN 53805: 1980-06, is in the range of 6 to 16 mm. Noils fall within the definition of recycled cotton fibers. As known, noils are short fibers that are produced as waste in yarn production, typically they are removed from the yarn during the combing process.

Table 1 below summarizes the dimensions of fibers of a blend of fibers used as a sheath in a yarn according to the invention. These results can be obtained by known methods (e.g. DIN 53805:1980-06 or ASTM D1447) and known machines (e.g. UsterAfis Pro 2 or Textechno FCS-Fibrotest).

TABLE 1

| fibers of the sheath | Preferred value(s) | Min | Max |
|---|---|---|---|
| Average Length L(n) | 12-20 | 10 | 25 |
| L(n) CV % | 60-70 | 50 | 80 |
| Short Fiber Content (less than 12 mm) SFC(n) % | >40 | 30 | 70 |

Please note that the above values are obtained according to DIN 53805:1980-06, i.e. as average value. The minimum (Min) and maximum (Max) of the above table are the minimum and maximum values of such an average value. As a result, with reference e.g. to the average length, embodiments of the invention have average length between 10 and 25 mm, preferably between 12 and 20 mm.

The following Tables 2 and 3 summarize corresponding values for the natural and man-made, or regenerated, staple fibers, respectively, used in the present invention.

TABLE 2

| Natural cellulosic fibers | Preferred value(s) | Min | Max |
|---|---|---|---|
| Average Length L(n) | 6-16 | 5 | 20 |
| L(n) CV % | 60-80 | 40 | 90 |
| Short Fiber Content (less than 12 mm) SFC(n) % | 50-70 | 40 | 80 |

TABLE 3

| Regenerated cellulosic fibers | Preferred value(s) | Min | Max |
|---|---|---|---|
| Average Length L(n) | 30-34 | 28 | 36 |
| L(n) CV % | 20-30 | 0 | 50 |
| Short Fiber Content (less than 12 mm) SFC(n) % | 1-5 | 0 | 10 |

For example, the recycled cotton fibers (short length fibers) may have the specifications below defined in terms of average fiber length, also referred to as "average fiber length numberwise" L(n).

Average fiber length numberwise L(n): 10.0 mm CV %: 70.0

Short fiber content—less than 12.0 mm %: 60.0.

A same histogram applied to viscose staple fibers typically provides the following values:

Average Fiber length (numberwise) L(n): 32.0 mm CV %: 24

Short fiber content (length less than 12 mm) SFC(n) %: 2.8

Above results are obtained with an Uster Afis Pro 2.

The average fiber length numberwise L (n) can be calculated by the following formula:

$$L_n = \frac{\sum n_i l_i}{\sum n_i}$$

where:

L(n) is the average fiber length numberwise, $n_i$ is the number of fibers having length $l_i$ and $l_i$ is the length of the fiber i.

Also, as known in the art, the Coefficient of Variation (CV %) is the ratio between the standard deviation s of a distribution of measures and its average value $\bar{x}$, namely:

$$CV\ \% = \frac{S}{\bar{x}} * 100$$

In the final blend of the sheath, the high 5% (n) index is mainly due to the presence of the longer regenerated cellulosic fibers, while the high SFC(n) value is mainly due to the presence of the short first fibers, e.g. of the recycled cotton fibers having high percent of short fibers.

According to the invention the yarn is a core spun yarn having a core comprising or consisting of polyester filaments. The linear density of the polyester filaments is in the range of 20 to 300 denier. The number of filaments is in the range of 6 to 288, while the total count for the final yarn in the range of 5/1 to 60/1 Ne. In preferred embodiments, the ratio by weight of the polyester filaments to the total weight of the yarn is in the range of 10 to 30%.

In embodiments, the elongation at break of the polyester filaments of the yarn core is less than 15%, more preferably between 8% and 12%, even more preferably between 10% and 12%, when tested with DIN ISO 2062.

According to an aspect of the invention, a yarn comprises a filament core and a staple fiber sheath. The fiber sheath is made of first and second fibers. The first fibers are natural cellulosic fibers, preferably recycled cotton staple fibers having an average length in the range of 6 to 16 mm, even more preferably about 10 mm.

The second fibers are man-made fibers, i.e. a regenerated staple fibers, preferably viscose, having an average length greater than average length of the first fibers, preferably between 25 mm and 40 mm, more preferably between 28 mm and 36 mm. High quality yarns have been achieved in particular with second fibers around 32 mm, such as between 30 and 34 mm.

At least 95% of the fibers of the sheath are the above-mentioned first and second fibers, wherein the weight ratio of the first fiber to the second fibers is between 70/30 and 80/20.

In other words, preferred embodiments have a sheath comprising (for at least 95% of its weight) a blend made of 70% to 80% of first fibers, namely of recycled cotton fibers, while the remaining portion 20% to 30% by weight, of the blend is made of the second fibers, namely of viscose.

In a preferred embodiment the recycled cotton fibers are about 75% by weight of the blend and the regenerated cellulosic fibers, e.g. viscose, are 25% by weight of the blend.

The blend of the fiber sheath as well as the presence of one or more polyester filaments in the core provides for the claimed fibers and filament to be workable into a yarn that is, in turn, workable into a fabric that has excellent properties on the market. In particular, the resulting yarn can be ring spun, that is a process that was previously not possible to perform in yarn having a high percentage of short fibers, such as recycled cotton fibers.

The average length of the fibers of the sheath (i.e. of all of the fibers of the sheath) is between 10 and 25 mm, preferably between 12 and 20 mm. The average length is the L(n) value measured according to DIN 53805:1980-06.

Test machines that can measure the above mentioned indexes, i.e. L(n), 5% (n), SFC(n), such as USTER AFIS PRO 2 or Textechno FCS-Fibrotest, are known in the art.

In the sheath, the 5% (n) index (as before, measured with DIN 53805:1980-06) of the fibers is at least 25 mm, preferably between 25 mm and 40 mm, more preferably between 28 and 38 mm, and wherein the short fiber content SFC(n) (measured with DIN 53805:1980-06) of the sheath is between 30% and 70%, wherein preferred values are above 35%, more preferably above 40%, i.e. between 40 and 70% or between 40 and 60%.

According to a preferred aspect, the elongation at break of the polyester filaments of the filament core is less than 15%, preferably between 5% and 15%, more preferably between 8% and 12%, even more preferably between 10 and 12%, when tested with DIN ISO 2062.

The claimed elongation at break is the elongation of all the filaments of the core, tested together.

In particular, it has been found that if the elongation of the core is low (i.e. less than 15% as per above discussed), the yarn production and the weaving processes are made easier. In particular, in these embodiments the elongation of the core is usually similar to the elongation of cotton fibers.

In fact, if the final yarn is tensioned, a high elongation (i.e. more than 15% or more than 20%) polyester core may cause slippage of the sheath from the core and/or may cause a breakage in the staple fiber sheath.

The use of low elongation polyester filament(s) in the core contributes in avoiding the above-mentioned problems.

Low elongation polyester filaments are known in the art and are commercially available. They may be obtained in different ways. A possible solution may be to provide a draft during a texturing step of POY polyester filaments. Such a draft is preferably between 1.7 and 2.5, more preferably between 1.8 and 2.1.

The polyester filaments are in fact preferably textured and, as mentioned, draft can be applied during texturing process, usually by also heating the filaments during the drafting step in the texturing process.

According to an aspect, the amount of the polyester filaments of the core is between 10% and 35% of the weight of the yarn, more preferably between 15% and 25%, even more preferably about 20%. The above percentage relates to the total count of polyester filaments, i.e. to the total sum of the count of the filaments.

According to an aspect, the total count of the polyester filaments is between 50 and 150 den, more preferably between 60 and 120 den, even more preferably between 75 and 100 den.

As mentioned, the second fibers of the sheath have an average length that is greater than the average length of the first fibers.

The fiber length can be measured via suitable machines such as Uster Afis Pro 2 or TexTechno FCS-Fibro test, with methods know in the art such as, AFIS (advanced fiber information system) according to DIN 53805:1980-06, or ASTM D1447.

In order to measure the fiber nature and fiber length (i.e. the L(n), SFC(n) and 5% (n) values) of the sheath of a finished yarn, the sheath should be initially separated from the core. This can be via un-twisting the yarn (i.e. applying a twist opposite to the one of the yarn, such as S-twisting a Z-twisted yarn). This can be done manually or by a twisting machine.

The obtained fibers can be then tested to determine their nature, i.e. to determine the presence of the natural cellulosic fibers and of the regenerated cellulosic fibers. Possible known methods are AATCC 20 and 20A, or ISO 1833.

Subsequently, the fibers length can be tested e.g. via DIN 53805 or ASTM D1447, via an USTER AFIS PRO 2 or a Textechno FCS-Fibrotest.

Preferably, in order to provide a better interaction between the first fibers and the second fibers of the sheath, the length of the second fibers is not too much greater than the length of the first fibers. A preferred ratio between the average length L(n) of the second fibers versus the average length L(n) of the first fibers is between 1.5 and 3.8, more preferably between 2 and 3.5. The best results have been found to occur when the above discussed ratio is between 2.5 and 3.3.

The yarn according to one or more of the preceding aspects can be used to produce a fabric, in particular a woven (preferably denim) fabric and a garment comprising such a woven fabric. It is in particular possible to produce a fabric wherein yarns according to the invention is used both in warp and weft direction.

It has been found that such a fabric, and in particular a garment made from such a fabric, can be made with no virgin (i.e. conventional) cotton, while having similar wearability properties (hand, softness, etc.) as well as optical properties (brightness, dyeability, etc.) with respect to a fabric made from conventional cotton yarns. Also, compared with fabrics made from yarns conventional cotton yarn, the fabric according to the present invention shows similar mechanical properties, such as similar tensile strength, as well as better abrasion properties.

As an example, abrasion of fabrics can be tested with BS EN ISO 12947-2 method e test, so that 25.000 to 30.000 cycles are performed.

If the test is continued even after those number of cycles, until the fabric breaks, a fabric according to the present invention has a greater resistance (i.e. it breaks after a greater number of cycles) with respect to a standard cotton yarns fabric, or a fabric made with recycled cotton yarns.

It has been tested that if three identical garment are tested, the only difference between the garments being a first garment being made with virgin cotton yarns, the second garments with yarns comprising recycled cotton, the third garment made according to the present invention, with recycled cotton fibers as first fibers, if the abrasion test is continued until the tested garment breaks, the third garment will last 2 to 3 times the duration of the first garment, and 3 to 4 times the duration of the second garment.

The core may consist of a plurality of polyester filaments, or may comprise also elastomeric filaments, such as elastane. Typically, in this case, the core consists of the polyester and elastomeric filaments.

The elastomeric filaments are usually in the range of 40 to 140 den, that are usually drafted at least 2.0 times, more preferably about 3 times before the sheath is applied, so that their count in the yarn would be smaller (with a 3.0 draft would be between about 13 and 47 den). In particular, the elastomeric filaments have preferably a draft of 2.0 to 4.0, more preferably of at least 2.5, most preferably of about 3.0.

An aspect of the present invention also relates to a blend of natural cellulosic staple fibers, preferably cotton staple fibers, and regenerated cellulose staple fibers, preferably viscose staple fibers, for a yarn according to any of the preceding aspects, wherein: the weight ratio of said natural cellulosic fibers to said regenerated cellulose fibers is in the range of 70/30 to 80/20, preferably said ratio being about 75/25; the average length of the fibers of the blend is in the range of 10 to 25 mm, preferably 12 mm to 20 mm; the 5% (n) index of the fibers of said blend is at least 25 mm, preferably at least 28, more preferably in the range between 28 and 38 mm; the short fiber content SFC(n) of the sheath is at least 30%, preferably at least 40%.

The present invention also relates to a method for producing a yarn comprising the steps of: a) Selecting a filament core, comprising a plurality of polyester filaments; b) Selecting first fibers that are natural cellulosic fibers; c) Selecting second fibers that are regenerated cellulosic fibers; d) Provide a staple fiber sheath, comprising at least 95% by weight of a blend of said first fibers and said second fibers, wherein the weight ratio of said first fibers to said second fibers is in the range of 70/30 to 80/20, preferably said ratio being about 75/25, wherein the fibers of the sheath have average length between 10 and 25 mm, preferably between 12 and 20 mm, wherein the 5% (n) index of the fibers of the sheath is between 25 mm and 40 mm, preferably between preferably between 28 and 38 mm, and wherein the short fiber content SFC(n) of the sheath is at between 30% and 70%, more preferably between 40% and 70%; combining said filament core and said staple fiber sheath, via ring spinning;

The present invention also relates to a method for producing a yarn comprising the steps of: a) Selecting a filament core, comprising a plurality of polyester filaments; b) Selecting a staple fiber sheath wherein at least 95% of the sheath is made of first fibers and second fibers, said first fibers being natural cellulosic fibers, preferably having an average length between 6 and 16 mm, said second fibers being regenerated cellulosic fibers, preferably having an average length greater than said first fiber and preferably greater than 25 mm, more preferably greater than 30 mm, said first fibers being recycled cotton fibers, said second fibers being regenerated cellulosic fibers, the weight ratio of said first fibers to said second fibers is in the range of 70/30 to 80/20, preferably said ratio being about 75/25; c) combining said filament core and said staple fiber sheath, preferably via ring spinning.

As mentioned, recycled materials are preferably used, so that the first fibers of the sheath are recycled cotton fibers and/or the polyester filaments is made from recycled polyester.

DETAILED DESCRIPTION OF THE INVENTION

Exemplary and non limiting embodiments will be now discussed with reference to the enclosed non limiting figures, where:

Figure 3A:
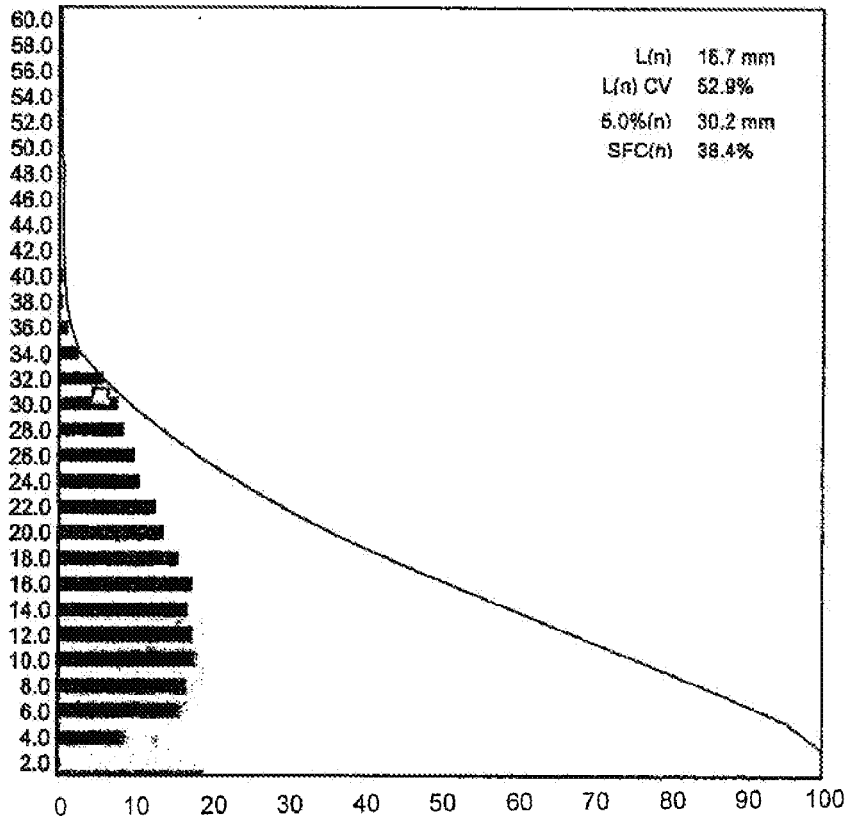
Figure 3B:
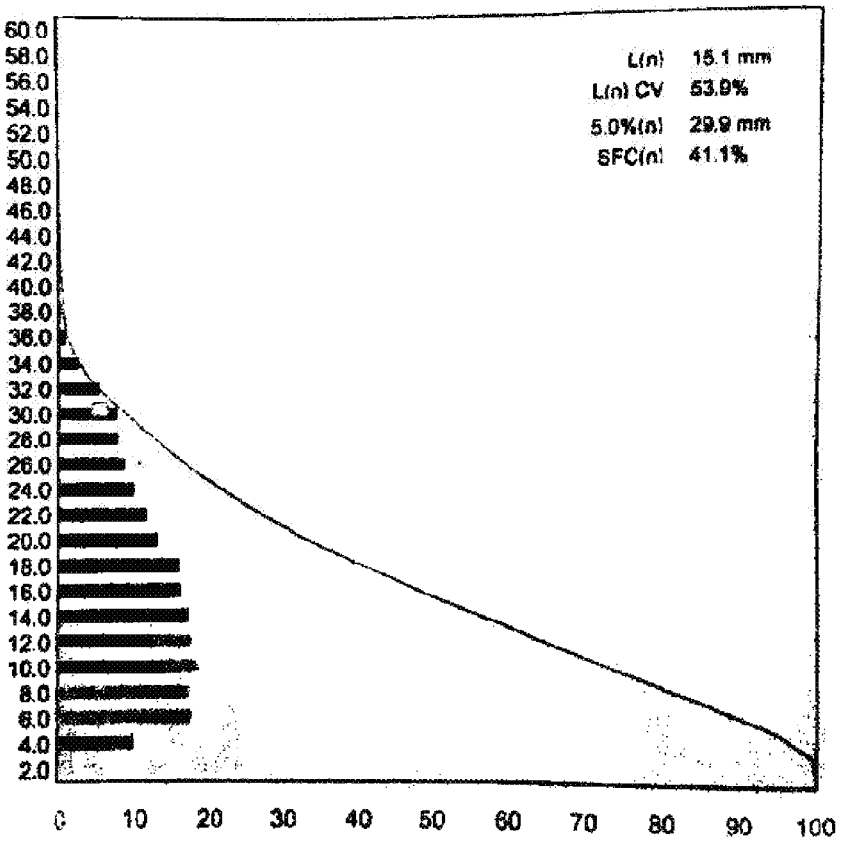

FIGS. 3*a* and 3*b* are a comparison of a test performed on fibers from the same yarns made according to the invention, as removed from a fabric (FIG. 3*a*) and before being woven (FIG. 3*b*).

For easiness of discussion, in the following generic discussion, reference will be made to:

- recycled cotton fibers as the first fibers of the sheath. However, unless specified, the following description applies to other natural cellulosic fibers as first fibers of the sheath;
- viscose fibers as the second fibers of the sheath. However, unless specified, the following description applies to other regenerated cellulosic fibers as second fibers of the sheath;
- elastane filaments possibly present in the core as the one or more elastomeric filaments. However, unless specified, the following description applies to cores comprising a single elastane filament, as well as one or more different elastomeric filaments.

In preferred embodiments, a yarn comprises a core provided with polyester filaments, and possibly also with elastane filaments; the sheath is made of staple fibers, comprising recycled cotton fibers and viscose fibers.

The polyester filaments are usually within 10% to 35% of the total weight of the yarn, usually about 20% of the yarn. The total count of the polyester filaments is typically between 20 and 300 den, while the most preferred embodiments use a total amount of polyester that is between 75 and 100 den.

The elongation at break of the polyester filaments (i.e. of the polyester component of the core) is less than 15%, more preferably between 8% and 12%, even more preferably between 10% and 12%. The test for elongation at break measurement is DIN ISO 2062.

As a comparison, a traditional polyester yarn, initially produced with the same method but without the claimed draft, will be heavier (i.e. as having a bigger count) and a greater elongation at break when tested with the same test, above 15%, usually in the range of about 17%-25%.

Elastane, if present, is usually highly drafted (with a draft of more than 2.0, usually about 3.0), and is present in low weight amount in the yarn, and is thus usually about 5 to 15% of the total weight of the yarn.

According to an aspect, the polyester filaments and the elastane filaments are combined together at least at a plurality of connecting points, in a known way, and preferably by means of intermingling, twisting or mechanical co-extrusion. As mentioned, the elastane filaments are preferably drafted before being combined with the polyester filaments.

According to an aspect, the continuous core fibers and the elastomeric filament(s) are connected together in a continuous or substantially continuous way by "mechanical co-extrusion" of the filaments, preferably in a tensioned condition. During such co-extrusion, also known as co-feeding, two (or more) bundles of fibers (in a tensioned state) are forced (fed together) through a restriction where the fibers attach together to such a degree that they remain attached also after exiting the restriction.

The sheath is composed of staple fibers. At least 95% of the staple fibers of the sheath are a blend of recycled cotton fibers 70% to 80% by weight of the blend being made of the recycled cotton fibers, while the blend are viscose fibers.

Preferred embodiments have about 75% of recycled cotton fibers and 25% of viscose fibers. The remaining portion (up to 5%), if present, may be other staple fibers. Typically, even if the blend of the recycled cotton and viscose fibers is not 100% of the fibers of the sheath, the recycled cotton fibers are at least 60%, usually at least 65%, of the weight of the sheath. When the blend of the recycled cotton and viscose fibers is substantially 100% of the fibers of the sheath, the recycled cotton fibers are between 70% and 80% of the weight of the sheath.

The average length of the recycled cotton fibers is between 6 and 16 mm.

Usually, more than 90% (in number) of the recycled cotton fibers are below 30 mm. Embodiments are possible where 50% of the fibers is below 15 mm.

The viscose fibers are longer than the recycled cotton fibers, in order to provide strength to the sheath. However, as mentioned, it is preferred that they are not too longer than the recycled cotton fibers, in order to promote coupling and blending of the fibers of the sheath.

The viscose fibers have an average length greater than 25 mm, preferably greater than 30 mm, usually between 28 mm and 36 mm. In particular, it has been noted that too long viscose fibers may lower the quality of the final yarn. In view of that, the most preferred embodiments use around 32 mm viscose fibers, such as between 30 mm and 34 mm. Typically, regenerated cellulosic staple fibers, such as viscose staple fibers, have uniform length, being produced via cutting of viscose filaments.

The viscose filaments are preferably chosen so that their average length is between 1.5 times and 3.8 times the average length of the recycled cotton fibers, preferably between 2 and 3.5 times, even more preferably between 2.5 and 3.3 times the average length of the recycled cotton fibers.

The viscose fibers and the recycled cotton fibers are mixed to form a blend that is at least 95% by weight of the fibers of the sheath. As discussed, the ratio (in weight) between the viscose fibers and the recycled cotton fibers is between 20/80 and 70/30.

The average length of the fibers of the sheath is between 10 and 25 mm, preferably between 12 and 20 mm, while the 5% (n) index of the fibers of the sheath is at least 25 mm, preferably between 25 mm and 40 mm, more preferably between 28 and 38 mm. The short fiber content SFC(n) of the sheath is at least 35%, preferably at least 40%.

Apparatuses for yarn production are known in the art, and are here not discussed in detail.

The production method of the yarn according to the present invention comprises providing a core, by drawing polyester filaments, and possibly combining them with elastane filaments.

The core is then combined with the sheath, that is usually provided in form of one or more rovings of staple fiber.

The obtained product is then spun into a yarn, preferably via ring spinning.

The obtained yarn can be used in a textile article and in particular, a plurality of yarns according to the invention can be used in a fabric. In particular they can be used as warp and/or weft yarns of the fabric.

It is in particular an object of the invention a fabric, preferably a denim fabric, wherein all the warp and weft yarns are yarns according to the invention.

Warp yarns can be dyed, e.g. indigo dyed, while weft yarns may be left undyed (though dyeing is possible).

As mentioned, a fabric obtained with the yarns according to the present invention is provided with improved abrasion performances with respect to fabrics made with standard cotton yarns and recycled cotton yarns.

An exemplary comparison is proposed as follows.

Fabric 1 is a fabric made with standard cotton yarns, while Fabric 2 is a fabric made with warp and weft yarns according to the invention.

Fabric 1 is made according to the following parameters:

warp yarns composition: 100% cotton
warp yarns count: 10/1 Ne
weft yarns composition: 94% cotton/6% elastane
weft yarns count: 16/1 Ne
fabric weave: 3/1 denim fabric,
fabric composition: 98% cotton/2% elastane.

Fabric 2 is made according to the following parameters:

warp yarns composition: 61% recycled cotton/20% viscose/19% recycled polyester
warp yarns count: 10/1 Ne (same as Fabric 1)
weft yarns composition: 60% recycled cotton/20% viscose/14 recycled polyester/6% elastane
weft yarns count: 16/1 Ne (same as fabric 1)
fabric weave: 3/1 denim fabric (same as fabric 1),
fabric composition: 60% cotton/20% viscose/18% recycled polyester/2% elastane.

The two fabrics were tested as follows:

TABLE 4

| Tear strength in grams | | Raw | After 5 home washes | After 10 home washes |
|---|---|---|---|---|
| Fabric 1 | weft | 3068 | 2832 | 2650 |
| | warp | 7577 | 7070 | 7030 |
| Fabric 2 | weft | 2982 | 3400 | 2832 |
| | warp | 8450 | 8304 | 7679 |

The tear test is carried out according to ISO 13937-1, 5 and 10 home washes are performed at 40° C., normal procedure, followed by tumble dry. In each cell, the upper line shows the value in weft direction, the bottom line shows the value in warp direction.

TABLE 5

| Tensile strength in Kg | | Raw | After 5 home washes | After 10 home washes |
|---|---|---|---|---|
| Fabric 1 | weft | 57.4 | 48.48 | 54.07 |
| | warp | 171.4 | 171.1 | 173.04 |
| Fabric 2 | weft | 58.8 | 47.97 | 53.24 |
| | warp | 167.5 | 172.38 | 174.48 |

The tensile strength test is carried out according to ISO 1393-1, 5 and 10 home washes are performed at 40° C., normal procedure, followed by tumble dry. In each cell, the upper line shows the value in weft direction, the bottom line shows the value in warp direction.

TABLE 6

| Abrasion resistance | Number of cycles needed to break the fabric |
|---|---|
| Fabric 1 | 93.000 |
| Fabric 2 | 186.000 |

The abrasion test is performed according to ISO 12947-2, and it is continued until the tested fabric breaks.

As visible from the above tests, a fabric according to the invention has similar tensile strength, slightly improved tear strength with respect to a standard virgin cotton fabric. As a result, a fabric according to the invention has similar wearability, while retaining similar optical properties, with respect to a standard virgin cotton fabric.

Also, the fabric of the invention shows better abrasion resistance, improving the life-span of the fabric.

Figure 1:
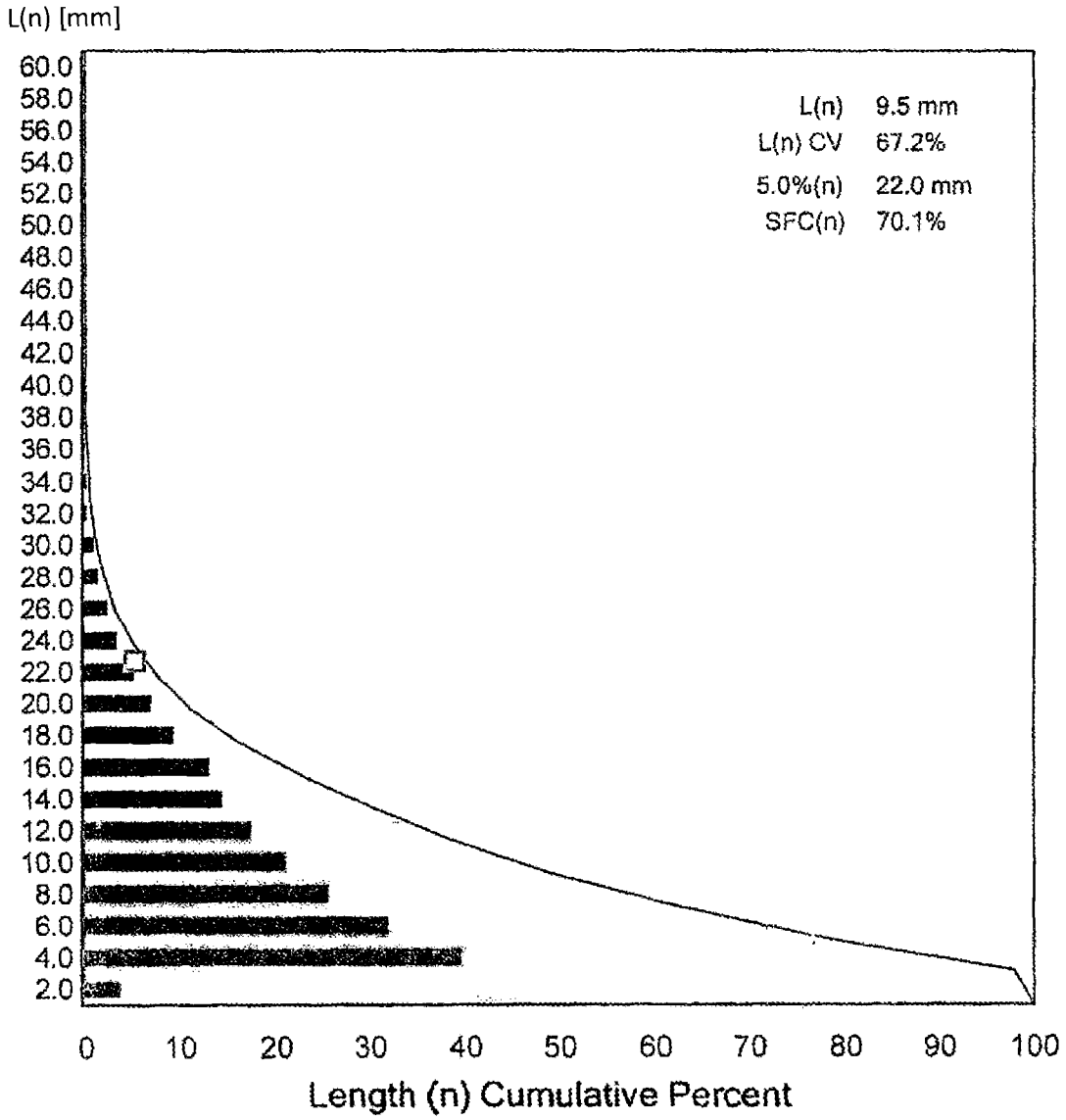
FIG. 1 is a histogram of recycled cotton fibers.
Figure 2:
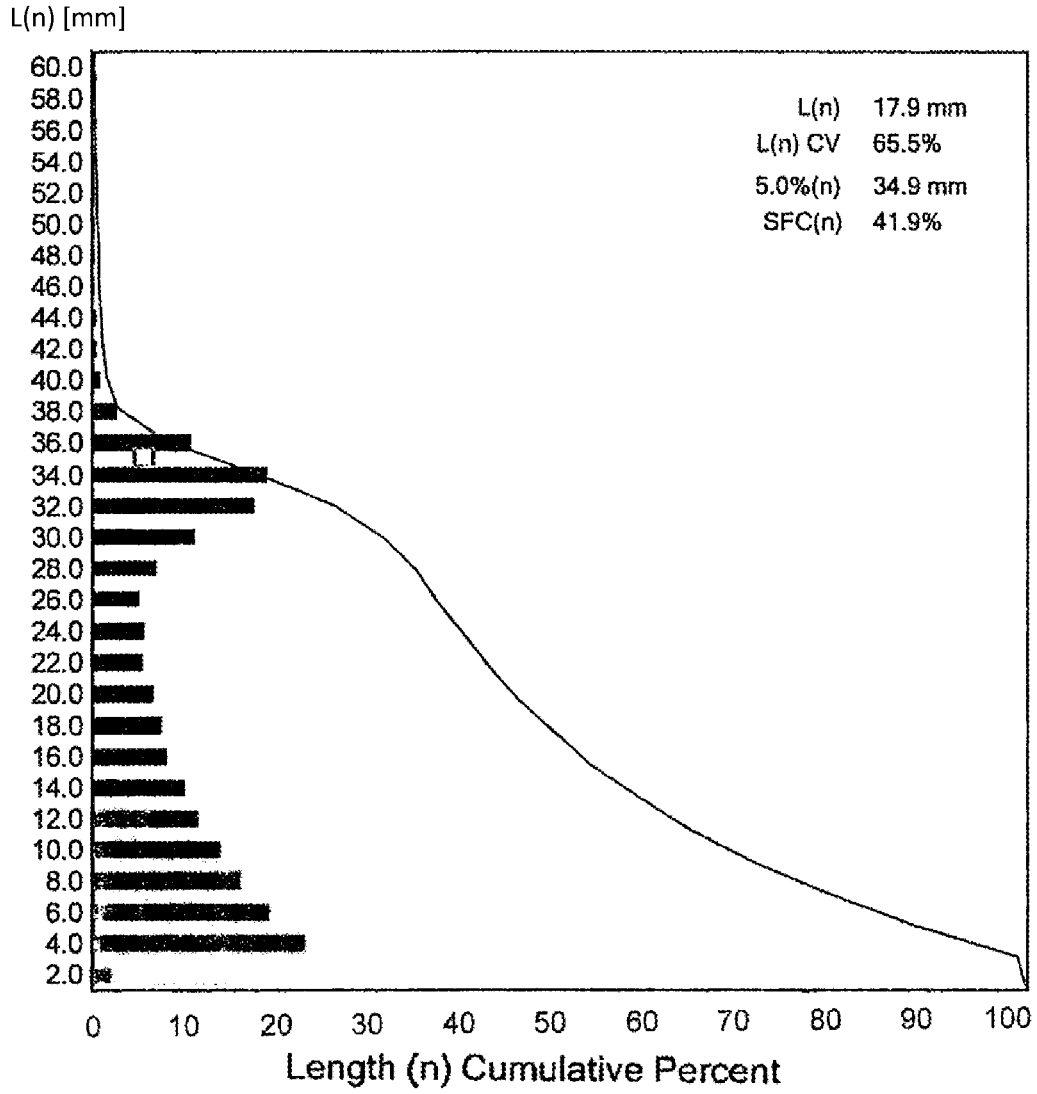
FIG. 2 is a histogram of a blend of fibers of a sheath of a yarn according to the invention.

Fiber composition and length can be tested according to the above discussed methods. They can be tested both before being woven, and after being woven, by removing them from a fabric, with similar results. In this regard, FIGS. 1 and 2 are test performed on fibers that are not being woven into a fabric. FIGS. 3*a* and 3*b* show the comparison between fibers from the same set of yarns according to the invention, wherein the fibers of the test of FIG. 3*a* come from a yarn removed from a fabric, while the fibers of the test of FIG. 3*b* come from a yarn after yarn production, before being woven into a fabric. As visible, the fiber length distribution is substantially the same.

The invention claimed is:

1. A yarn comprising a filament core and a staple fiber sheath, said staple fiber sheath comprising at least 95% by weight of a blend of first fibers and second fibers, wherein said first fibers are natural cellulosic fibers and said second fibers are regenerated cellulosic fibers, wherein:

a weight ratio of said first fibers to said second fibers is in a range of 70/30 to 80/20;

an average length of the first and second fibers of the sheath is in a range of 10 to 25 mm;

a 5% (n) index of the first and second fibers of the sheath is between 25 mm and 40 mm;

a short fiber content SFC(n) of the sheath is between 30% and 70%; said filament core comprises a plurality of polyester filaments; and an amount of the polyester filaments of the core is in a range of 10% to 30% of a weight of the yarn.

2. The yarn of claim 1, wherein an elongation at break of the polyester filaments of the filament core, according to DIN ISO 2062 measurement standards, is in a range of 5% to 15%.

3. The yarn of claim 1, wherein the natural cellulosic fibers are recycled cotton fibers.

4. The yarn of claim 1, wherein a ratio of the average length of regenerated cellulosic fibers to the average length of the first fibers is in a range between 1.5 and 3.8.

5. The yarn of claim 1, wherein the core comprises one or more elastomeric filaments drafted to have a length of 2.0 to 4.0 times an original length of the one or more elastomeric filaments.

6. The yarn of claim 1, wherein the polyester filaments are drafted to have a length of 1.5 and 2.5 times an original length of the polyester filaments.

7. The yarn of claim 1, wherein the polyester filaments are textured filaments.

8. The yarn of claim 1, wherein the polyester filaments have a denier between 50 and 150.

9. The yarn of claim 1, wherein wherein the polyester filaments of the core have a linear density in a range of 20 to 300 denier.

10. A textile article comprising a denim fabric or garment comprising the yarn according to claim 1.

11. The yarn of claim 1, wherein said natural cellulosic staple fibers comprise cotton staple fibers, and said regenerated cellulose staple fibers comprise viscose staple fibers.

12. The yarn of claim 1, wherein the weight ratio of said first fibers to said second fibers is about 75/25, the average length of the first and second fibers of the sheath is in the range of 12 mm to 20 mm, the 5% (n) index of the first and second fibers of the sheath is between 30 and 34 mm and the short fiber content SFC(n) of the sheath is between 40% and 60%.

13. The yarn of claim 1, wherein the natural cellulosic staple fibers comprise cotton staple fibers and the regenerated cellulose staple fibers comprise viscose staple fibers.

14. The yarn of claim 1, wherein the polyester filaments comprise recycled polyester.

15. A method for producing a yarn comprising the steps of:

A) selecting a filament core comprising a plurality of polyester filaments;

B) selecting first fibers that are natural cellulosic fibers;

C) selecting second fibers that are regenerated cellulosic fibers;

D) providing a staple fiber sheath comprising at least 95% by weight of a blend of said first fibers and said second fibers, wherein a weight ratio of said first fibers to said second fibers is in a range of 70/30 to 80/20, the first and second fibers of the sheath have an average length between 10 and 25 mm, a 5% (n) index of the first and second fibers of the sheath is between 25 mm and 40 mm, and a short fiber content SFC(n) of the sheath is at between 30% and 70%; and E) combining said filament core and said staple fiber sheath, via ring spinning wherein an amount of the polyester filaments of the core is in a range of 10% to 30% of a weight of the yarn.

16. The method of claim 15, wherein the first fibers of the sheath are recycled cotton fibers.

17. The method of claim 15, wherein the polyester filaments are made from recycled polyester.

18. The method according to claim 15, wherein the elongation at break of the polyester filaments of the filament core is in the range of 5% to 15%, when tested with DIN ISO 2062.

19. The method of claim 15, wherein the weight ratio of said first fibers to said second fibers is about 75/25, the first and second fibers of the sheath have average length between 12 and 20 mm, the 5% (n) index of the first and second fibers of the sheath is between 28 and 36 mm, and the short fiber content SFC(n) of the sheath is at between 40% and 60%.

* * * * *